US009889343B2

(12) United States Patent
Retkowski et al.

(10) Patent No.: US 9,889,343 B2
(45) Date of Patent: Feb. 13, 2018

(54) ELASTICALLY DEFORMABLE ITEM OF SPORTS EQUIPMENT COMPRISING A DEFORMABLE ELECTROMAGNETIC COIL STRUCTURE

(71) Applicant: FRAUNHOFER-GESELLSCHAFT ZUR FOERDERUNG DER ANGEWANDTEN FORSCHUNG E.V., Munich (DE)

(72) Inventors: Reiner Retkowski, Erlangen (DE); Markus Hartmann, Sulzbach-Rosenberg (DE)

(73) Assignee: FRAUNHOFER-GESELLSCHAFT ZUE FOERDERUNG DER ANGEWANDTEN FORSCHUNG E.V., München (DE)

( * ) Notice: Subject to any disclaimer, the term of this patent is extended or adjusted under 35 U.S.C. 154(b) by 0 days.

(21) Appl. No.: 14/651,171

(22) PCT Filed: Nov. 26, 2013

(86) PCT No.: PCT/EP2013/074754
§ 371 (c)(1),
(2) Date: Jun. 10, 2015

(87) PCT Pub. No.: WO2014/090572
PCT Pub. Date: Jun. 19, 2014

(65) Prior Publication Data

US 2015/0328502 A1 Nov. 19, 2015

Related U.S. Application Data

(60) Provisional application No. 61/736,823, filed on Dec. 13, 2012.

(30) Foreign Application Priority Data

Jan. 10, 2013 (DE) ..... 10 2013 100 216

(51) Int. Cl.
*A63B 43/00* (2006.01)
*H01F 41/06* (2016.01)
(Continued)

(52) U.S. Cl.
CPC ..... *A63B 41/00* (2013.01); *A63B 43/004* (2013.01); *H01F 5/00* (2013.01); *H01F 41/071* (2016.01);
(Continued)

(58) Field of Classification Search
CPC ..... A63B 41/00; A63B 43/004; A63B 43/06; A63B 2225/54; Y10T 29/49073;
(Continued)

(56) References Cited

U.S. PATENT DOCUMENTS 3,397,885 A 8/1968 Nash, Jr.
3,774,194 A 11/1973 Jokay et al.
(Continued)

FOREIGN PATENT DOCUMENTS

CN 101073703 A 11/2007
CN 101732832 A 6/2010
(Continued)

OTHER PUBLICATIONS

International Search Report PCT/ISA/210 for International Application No. PCT/EP2013/074754 dated Feb. 18, 2014.
(Continued)

*Primary Examiner* — Steven Wong
(74) *Attorney, Agent, or Firm* — Harness, Dickey & Pierce, P.L.C.

(57) ABSTRACT

Embodiments relate to a concept for an elastically deformable item of sports equipment comprising at least one deformable electromagnetic coil structure around a curved surface within the item of sports equipment, such that the at least one electromagnetic coil structure forms a three-di-
(Continued)

mensional curve having non-vanishing geometric torsion and curvature to provide an elongation reserve related to a maximum deformation of the item of sports equipment.

20 Claims, 3 Drawing Sheets

(51) Int. Cl.

| | |
|---|---|
| ***A63B 41/00*** | (2006.01) |
| ***H01F 5/00*** | (2006.01) |
| ***H01Q 7/00*** | (2006.01) |
| ***H01Q 1/36*** | (2006.01) |
| ***H01Q 21/28*** | (2006.01) |
| ***H01F 41/071*** | (2016.01) |

(52) U.S. Cl.
CPC ..... *H01Q 1/36* (2013.01); *H01Q 7/00* (2013.01); *H01Q 21/28* (2013.01); *A63B 2225/54* (2013.01); *Y10T 29/49073* (2015.01)

(58) Field of Classification Search
CPC ..... H01F 5/00; H01F 41/071; H01Q 7/00; H01Q 1/36; H01Q 21/28
See application file for complete search history.

(56) References Cited

U.S. PATENT DOCUMENTS

| | | | | |
|---|---|---|---|---|
| 4,375,289 | A | 3/1983 | Schmall et al. | |
| 5,150,895 | A * | 9/1992 | Berger | A63B 71/0605 473/467 |
| 5,639,076 | A * | 6/1997 | Cmiel | A63B 43/06 362/806 |
| 5,755,634 | A * | 5/1998 | Huang | A63B 43/00 473/570 |
| 5,779,575 | A * | 7/1998 | Hsieh | A63B 43/06 473/570 |
| 9,735,472 | B2 * | 8/2017 | Bernhard | H01Q 7/02 |
| 2008/0274844 | A1 * | 11/2008 | Ward | A63B 43/00 473/570 |
| 2010/0069181 | A1 * | 3/2010 | Lin | A63B 43/06 473/570 |
| 2010/0130314 | A1 * | 5/2010 | Von Der Gruen | A63B 63/00 473/570 |
| 2010/0130315 | A1 * | 5/2010 | Steidle | A63B 41/02 473/570 |
| 2010/0222163 | A1 * | 9/2010 | Eskildsen | A63B 63/00 473/570 |
| 2011/0077112 | A1 * | 3/2011 | Erario | A63B 41/02 473/570 |
| 2013/0274040 | A1 * | 10/2013 | Coza | G09B 19/0038 473/570 |
| 2014/0256478 | A1 * | 9/2014 | Gale | A63B 43/004 473/465 |

FOREIGN PATENT DOCUMENTS

| | | | |
|---|---|---|---|
| CN | 101883613 | A | 11/2010 |
| EP | 1852155 | A1 | 11/2007 |
| WO | WO-2010065886 | A1 | 6/2010 |
| WO | WO-2014000828 | A1 | 1/2014 |

OTHER PUBLICATIONS

Written Opinion of the International Searching Authority PCT/ISA/237 for International Application No. PCT/EP2013/074754 dated Feb. 18, 2014.
International Report on Patentability dated Jun. 18, 2015.
Office Action dated May 24, 2015 in Chinese Application No. 2013800651665.
Decision to Grant a Patent for an Invention dated Dec. 9, 2016 in RU Application 2015125087/12(039037).

* cited by examiner

ELASTICALLY DEFORMABLE ITEM OF SPORTS EQUIPMENT COMPRISING A DEFORMABLE ELECTROMAGNETIC COIL STRUCTURE

CROSS REFERENCE TO RELATED APPLICATIONS

This application is the National Phase under 35 U.S.C. § 371 of PCT International Application No. PCT/EP2013/074754, which has an International filing date of Nov. 26, 2013, and which claims priority to U.S. provisional patent application No. 61/736,823, filed on Dec. 13, 2012, and to German patent application number 10 2013 100 216.1 filed on Jan. 10, 2013, the entire contents of all of which are incorporated herein by reference.

BACKGROUND

Field

Embodiments of the present invention generally relate to elastically deformable items of sports equipment or pieces of play equipment, such as inflatable balls, and more particularly to elastically deformable items of sports equipment comprising at least one deformable electromagnetic coil structure arranged around a curved surface within the item of sports equipment.

Description of Conventional Art

An electromagnetic coil, or simply a coil, is formed when an electrical conductor, such as a copper wire, is wound to generate an inductive or electromagnetic element. Here, the wire may also be wound around a core or a form. One loop of wire may be referred to as a turn, and a coil comprises one or more turns. Coils serving as inductors and/or inductances are widespread in electronic circuits as a passive two-terminal electrical component that stores energy in its magnetic field. For example, coils may be used for realizing transformers by means of which energy is transferred from one electrical circuit to another by inductive coupling without moving parts. Furthermore, coils may be used to build resonant circuits comprising serial and/or parallel arrangements of inductors and capacitors. In some applications, coils may also serve as antennas or antenna-like elements for detecting electromagnetic fields, such as in Radio Frequency Identification (RFID) or similar applications.

In one of such applications, for example, it is proposed to detect the transition of a moving playing object, such as a ball or a puck, through a detection plane (e.g., a goal plane) using electromagnetic fields and/or signals. In some types of ball sports, e.g., soccer or football, the use of automated goal-detection systems is discussed in order to avoid human errors in decision-making. In this context, the so-called goal-line technology is a technology which can determine when the ball has crossed the goal line, assisting the referee in awarding a goal or not. There are various alternative approaches for determining the exact position or location of the ball, such as video-based or electromagnetic field-based systems. In an electromagnetic field-based system, a moving object, such as a ball, may be equipped with an electronic circuit for transmitting and/or receiving and/or reflecting electromagnetic signals. For such electromagnetic approaches, electronic components are required inside the ball, wherein the size of the electronics may differ depending on its functionality and the used frequency range. For small and medium-sized systems, electronics may be installed within the center of the ball, for example. For goal-detection systems requiring more area and volume, e.g., for systems using magnetic fields in the sub-MHz range, the required loop antennas and/or the further electronic components may be installed on the circumference of the ball.

In order to achieve detection properties which are as rotationally invariant as possible, one goal-detection system proposes to install three orthogonally arranged coils or loop antennas within or on a moving object, e.g., a ball, to emit or reflect at least a part of an electromagnetic field. Due to this orthogonal arrangement of the coils, the rotational position of the ball has only little influence on the electromagnetic emission or reflection properties, as, in theory, the three orthogonal loop antennas result in an effective loop antenna, whose effective opening surface is perpendicular to an incident magnetic field coming from a transmitter installed at or near the goal. That is to say, the normal of the effective opening surface of the effective loop antenna is essentially parallel to the magnetic field vector.

For a correct functioning, i.e., high precision of goal-detection systems, the electromagnetic properties of the ball or a puck are of crucial importance. In one exemplary goal-detection system, a magnetic field may be generated by means of a current-carrying conductor extending around a goal frame. The generated magnetic field is here perpendicular to a detection plane defined by the goal frame. This stimulating magnetic field is reflected by the ball, wherein the reflected signal should generate the same directional vector as the stimulating field (due to the ball electronics with a phase shift). The geometric accuracy of the reflected signal directly influences the measurement result and, hence, the accuracy of the goal decision.

The detection system is based on three orthogonal coils in the ball. Each of the coils may comprise a plurality of turns which may, for example, be inserted between the ball bladder and the outer ball skin or the cover material of the ball. In order to obtain an adequate quality of a resonant coil in the ball, the diameter of the coil(s) should be as large as possible, which means that the coil(s) should be installed in or underneath the ball cover material.

However, as a result of the elasticity of the ball cover material which, for example, may consist of several leather patches, all pulses which strike the ball from the outside may be directly passed on to a coil in the ball. For the coil not to break as a result of such pulses, the coil itself should be elastic. It is known to insert coils with electrical conductors in a meandering manner into a ball, such that a longitudinal axis of the coil(s) can be elongated in circumferential direction, respectively. However, on account of the permanent load on the coil, fatigue fractures already occur at the corners of the meandering conductor before the end of the required operating life. Exemplary breaking points which are to be attributed to fatigue fractures of a coil structure are schematically illustrated in FIG. 1.

Hence, there is a demand for providing an improved concept for arranging one or several coil(s) into balls or items of sports equipment in general.

SUMMARY

For a best possible system performance of an electromagnetic field-based goal detection system, preferably three essentially mutually orthogonal loop antennas or electromagnetic coils may be integrated into an item of sports equipment and/or a piece of play equipment, which, according to some embodiments, may be an air-inflatable ball, such as a soccer ball. Normally, such an air-inflatable ball, like a soccer ball or a handball, comprises at least one outer ball cover material and/or a ball hull, i.e., an outer ball skin, and an inner ball bladder underneath the outer skin. It is also possible to add additional material between the outer skin and the bladder to protect the bladder against outside impacts, for example, stitches or the like. Although embodiments of the present invention are also applicable to playing equipment other than balls, the principles of the present invention will be predominantly explained with respect to inflatable balls.

A reflected electromagnetic signal from the integrated loop antennas or coils in a ball depends on the circumference or diameter of the at least one loop antenna in the ball. That is to say, the higher the loop diameter the higher the signal strength of a reflected signal will be, and the better the detection rate of an electromagnetic field-based goal detection system will be. As a consequence, in order to obtain as high a loop antenna diameter as possible, the at least one loop antenna in the ball should be fitted to an outer shape of the ball. This may be done by placing a loop antenna in the form of an electromagnetic coil directly under the outer ball skin, between the outer skin and the bladder or an additional protection tissue, or inside the ball bladder next to the inner wall of the bladder. However, when doing this, an elastic deformation of the ball comprising an outer skin and a bladder may be directly transferred to the integrated electromagnetic coils. Without any countermeasures, the coils may be damaged in case of elastic ball deformations.

Hence, embodiments of the present invention aim to provide coils which can withstand and/or adapt to elastic deformations of a ball, and items of sports equipment in general.

For this purpose, the at least one electromagnetic coil structure integrated into an elastically deformable item of sports equipment may be implemented such that the electromagnetic coil structure has an elongation reserve (an expansion buffer) preferably corresponding to a maximum elastic deformation of the item of sports equipment during game operations. The elongation reserve may here be in a range of 5% to 30% of the "normal" length.

According to a first aspect, embodiments provide an elastically deformable item of sports equipment, comprising at least one deformable electromagnetic coil structure arranged around a curved surface within the item of sports equipment, wherein at least one part of the electromagnetic coil structure comprises a three-dimensional curve space having a non-vanishing turn (or torsion) and curvature (similar to a coiled cable) in order to provide an elongation reserve corresponding or related to a maximum elastic deformation of the item of sports equipment. The turn and/or torsion of a curve space is used here to measure how strongly the space curve deviates from its plane course. Taken together, the curvature and the turn of a space curve are in line with the curvature of a plane curve. Together with the curvature, the turn describes the local behavior of the space curve.

Hence, embodiments suggest distributing a mechanical load more uniformly to all sections of an electrical conductor of the coil structure in the item of sports equipment. For this purpose, a traditional two-dimensional meandering structure may be extended to a third dimension, thus producing a spiral-like or helix-like shape of a coil, or at least a part thereof, in circumferential direction in some embodiments.

The curved surface within the item of sports equipment may, in an undeformed or non-deformed condition of the item, be a spherical surface comprising a circumference, wherein a length (in circumferential direction) of at least one spirally wound turn of the coil structure may be larger than said circumference in some embodiments to allow for said elongation reserve in circumferential direction. The elongation reserve may be in a range of 5% to 30% of the circumference.

For example, the curved surface may be the inner or outer surface of a ball bladder or the inner or outer surface of an outer skin of the ball. That is to say, some embodiments of the present invention suggest integrating electromagnetic coils into the item of sports equipment, which may preferably comprise a larger circumference than the item of sports equipment itself. This can be realized by shaping a coil as a three-dimensional space curve having non-vanishing torsion and curvature, i.e., being spirally or helically wound around a circumferentially extending axis being curved according to the curved surface, similar to a coiled cable. This may also simply be an imaginary axis.

That is to say, in embodiments an electrical conductor of the at least one electromagnetic coil structure may be arranged essentially spirally along a circular path or extend around the curved surface. The circular path may here be obtained by intersecting a plane through the center of the curved, in particular, spherical surface and the curved or spherical surface itself, leading to a circle on the spherical surface having the same circumference as the spherical surface.

If a deforming force now acts in longitudinal direction (i.e., along the circumferential direction) of the three-dimensional spiral-like coil having the non-vanishing geometric torsion and curvature, such as of a spiral or helix, a bending moment which has hitherto only acted on the corners of the two-dimensionally meandering conductors may be converted into mechanical torsion which may be distributed uniformly to all points of the electrical conductor of the at least one deformable electromagnetic coil structure. In this case, the pitch or gradient of the three-dimensionally curved electromagnetic coil having the non-vanishing geometric torsion and curvature and the material used may be preferably matched to one another such that the maximum mechanical torsion occurring never becomes greater than the elasticity range of the electrical conductor of the coil. As long as the elasticity range is not left, the coil can virtually be considered to be indefinitely durable. This may solve the technical problem of a premature failure of the coil.

Hence, there are embodiments which propose winding an electrical conductor of the coil structure with a non-vanishing gradient (in circumferential direction) around the lateral surface of a cylinder or tube which is curved according to the curved or spherical surface and extends along a circular path of the essentially spherical surface within the item of sport equipment. We can also say that the coil is wound spirally around a torus. In order to produce such spiral or helical coils, there is the option to wind their electrical conductor around a torus-like, elastic core, e.g., comprising a caoutchouc-like and/or rubber-like material, or producing a hollow spiral and/or hollow helix. The respective design depends on the mechanical properties of the electrical conductor.

As mentioned before, the embodiments are not strictly limited to balls as items of sport equipment. Generally, an item of sports equipment may be understood as any movable playing object or equipment. Therefore, an ice hockey puck may also be understood as an item of sports equipment in the context of this specification, for example. That is to say, the item of sports equipment may belong to the group of a soccer ball, an American football ball, a rugby ball, a basketball, a handball, a volleyball, a tennis ball, a billiard ball, a bowling ball, or a puck. Note that this exemplary list is not to be understood as being conclusive. Principles of the present invention may also be transferred to other items of sports equipment or playing equipment.

The at least one electromagnetic coil structure may comprise at least one turn of an electromagnetic coil or loop antenna extending (spirally) on a circular path (i.e., along the circumference) along the curved or spherical surface. In other words, the at least one turn of the electromagnetic coil or loop antenna may extend spirally around an imaginary or actually existing (elastic) torus around the curved or spherical surface. The electromagnetic coil structure will typically comprise more than one coil. In a preferred embodiment, the electromagnetic coil structure comprises at least three electromagnetic coils arranged perpendicular or orthogonal to each other around the circumference of the curved surface within the item of sports equipment, i.e., the ball. In particular, in some embodiments, the three spirally wound electromagnetic coils may be arranged on a spherical surface within the item of sports equipment, e.g., between a ball bladder and an outer ball skin or cover material of the ball.

The elasticity of the conductive material itself is significantly lower than the elasticity of a ball hull, a ball bladder, or an intermediate protection tissue, as the coils typically comprises electrically conductive material like copper, silver or aluminum. On the other hand, the stiffness of the coils acts against the deformation of the ball, and the dynamic behavior of the ball can be heavily influenced. For this reason, some embodiments suggest spiral patterns of the windings of the at least one coil structure. That is to say, the length of the at least one turn of the coil structure being larger than the circumference of the spherical surface may be realized by winding the electrical conductor of the coil around a circumferentially extending and curved (imaginary) tube, i.e., a torus (section). That is to say, an electrical conductor of the at least one deformable electromagnetic coil structure may be arranged (at least in sections) in a three-dimensional spiral or helical pattern around the curved surface of the item of sports equipment. Here, a helical line winds around a(n) (imaginary) lateral surface of a(n) (imaginary) cylinder comprising a curved longitudinal axis (also referred to as a torus or torus section) which extends in circumferential direction around the curved and/or spherical surface.

In some embodiments, it may be beneficial to support the at least one deformable electromagnetic coil structure by an elastic and/or flexible carrier or embedment material in order to better support the spiral shape of the coil structure in the playing equipment. Such a set-up which helps to protect a spirally-wound coil from being radially expanded, e.g., by normal air pressure of the sports object, may be placed within an inner bladder or between the inner bladder and an outer cover material of the sports object. Thereby, the elastic and/or flexible carrier or embedment material, which may be rubber or a similar material, is preferably stiff enough to keep its form or geometry under normal air pressure of the air-inflatable ball, but is also flexible enough to transfer, for example, ball compressions caused by hitting the ball or shooting the ball against a goal frame.

Alternatively or additionally, one or several (parallel) electrical conductors of the electromagnetic coil structure may comprise a first section being wound with a first spiral orientation (e.g., right-hand) and a second section being wound with a second, e.g., opposite spiral orientation (e.g., left-hand). Here, a plurality of parallel conductors may essentially be wound in parallel in the respective spiral orientation. The first and the second spiral orientations may lead to at least one intersection of the first and the second sections of the at least one electrical conductor. In other words, the first and the second sections of the at least one conductor may be wound around the lateral surface of a(n) (imaginary) curved cylinder and/or curved tube in opposite directions, e.g., clockwise and counter-clockwise. Further, the first and the second sections of the conductor may be twisted, intertwined or braided. Thus, a coil may, for example, comprise a plurality of braided conductors (a conductor braid), e.g., copper wires. This may also help to provide more stability to the coil structure.

In other embodiments of the present invention, the elongation reserve of the electromagnetic coil structure may additionally be accomplished by employing elastic electrical conductors, such that the elastic or stretchable conductors themselves may act similar to rubber bands placed around the curved or spherical surface within the item of sports equipment. For example, such elastic conductors may be based on silver nanowire conductors or carbon nanotubes to obtain extendible and/or stretchable electromagnetic coils for the electromagnetic coil structure. Additionally, these elastic conductors may be placed on a stretchable substrate for better support and guidance properties of the flexible coils.

As has been explained before, the item of sports equipment may be an inflatable ball having a ball bladder and a ball cover material or an outer ball skin, wherein the at least one deformable electromagnetic coil structure may be arranged in between the ball bladder and the ball skin in some embodiments. In other embodiments, the at least one deformable electromagnetic coil structure may also be arranged within the ball bladder or underneath the surface of the ball bladder. It is even possible to arrange the at least one deformable electromagnetic coil structure on the outer surface of the ball skin in some embodiments.

Optionally, the item of sports equipment may comprise a means for fixing a position of the at least one deformable electromagnetic coil structure on the curved surface underneath a cover material of the item of sports equipment. In some embodiments, the means for fixing may be realized by using seams/threads in the ball cover material or dedicated fixation straps arranged around the curved surface at regular intervals. The fixation straps may be adhesive according to some embodiments. In other embodiments, the electromagnetic coil structure may also be stuck to the curved surface (e.g., a ball bladder) within the item of sports equipment. For this purpose, double-face tape may be used in some embodiments. Using the one side, the band can be stuck to the bladder, and the coil structure may be stuck to the fixed band on the other side.

In some embodiments, it may be beneficial to integrate several electrical components together with the at least one coil in the item of sports equipment to a unit. For example, capacitive or resistive components may be integrated together with the coil structure to implement one or more resonant circuits in the item of sports equipment. That is to say, in some embodiments the elastically deformable item of sports equipment may further comprise at least one capacitive element connected to the at least one electromagnetic coil structure to form a resonant circuit for a predetermined frequency or frequency range. For example, the frequency range may be in the sub-megahertz region, i.e., 10 kHz to 150 kHz. This may be particularly interesting for backscatter coupling concepts, wherein antennas installed at the goal are inductively coupled to one or more coils in the ball via backscattering. Here, backscattering (inductive coupling) uses the electromagnetic power transmitted by a transmitter to energize the electronics in the ball. Essentially, the ball may reflect some of the transmitted power, but change some of the properties, and in this way may also send back information to the transmitter.

In some embodiments, the at least one capacitive element may be integrated into the cover material of the item of sports equipment or into an area of the cover material, such as individual leather patches. In other embodiments, the capacitive element may be arranged closely to a cooperating coil, if possible on the same substrate as the coil. This may allow for an efficient manufacturing process and for good resonant properties.

According to a further aspect of the present invention, it is provided a method for manufacturing an elastically deformable item of sports equipment, in particular an air- or gas-inflatable ball, comprising a step of arranging at least one deformable electromagnetic coil structure around a curved surface (such as a ball bladder) within the item of sports equipment, such that the electromagnetic coil structure essentially forms a three-dimensional spiral-like curve having non-vanishing geometric torsion and curvature to provide (in circumferential direction) an elongation reserve related to a maximum deformation of the item of sports equipment.

Hence, embodiments of the present invention suggest solutions to the problem as to how the at least one coil has to be designed and as to how it can be integrated into the ball to withstand the mechanical deformation of the ball when hit by a player or shot against the goal frame. Some embodiments suggest a coil having at least one turn wound from an elastic conductive structure which may be produced by winding an electrical conductor in the form of a spiral around an elastic core. A plurality of conductors may here be wound in parallel around the core, wherein the plurality of conductors may be wound in the same or in an opposite direction in a different distribution. In some embodiments, the coil may form a three-dimensional hollow spiral and/or hollow helix. In order to stabilize the winding of the coil structure, a spiral-like winding in the opposite direction may be additionally applied. That is to say, while one spiral-like winding of the coil structure may be oriented clockwise, a further spiral-like winding of the coil structure may be oriented counter-clockwise. In some embodiments, the conductors applied in both winding directions may be intertwined or twisted with one another.

In embodiments, individual electrical conductors are connected at one end of a winding to the start of the winding such that a continuous winding may be produced. That is to say, the total number of turns of a coil is therefore the number of conductors times the number of turns of the elastic core.

BRIEF DESCRIPTION OF THE DRAWINGS

Some embodiments of apparatuses and/or methods will be described in the following by way of example only, and with reference to the accompanying figures, in which FIG. 1 schematically illustrates exemplary breaking points which are to be attributed to fatigue fractures of a meandering coil structure.

DETAILED DESCRIPTION

Various example embodiments will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the invention. Like numbers refer to like or similar elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Figure 2A:
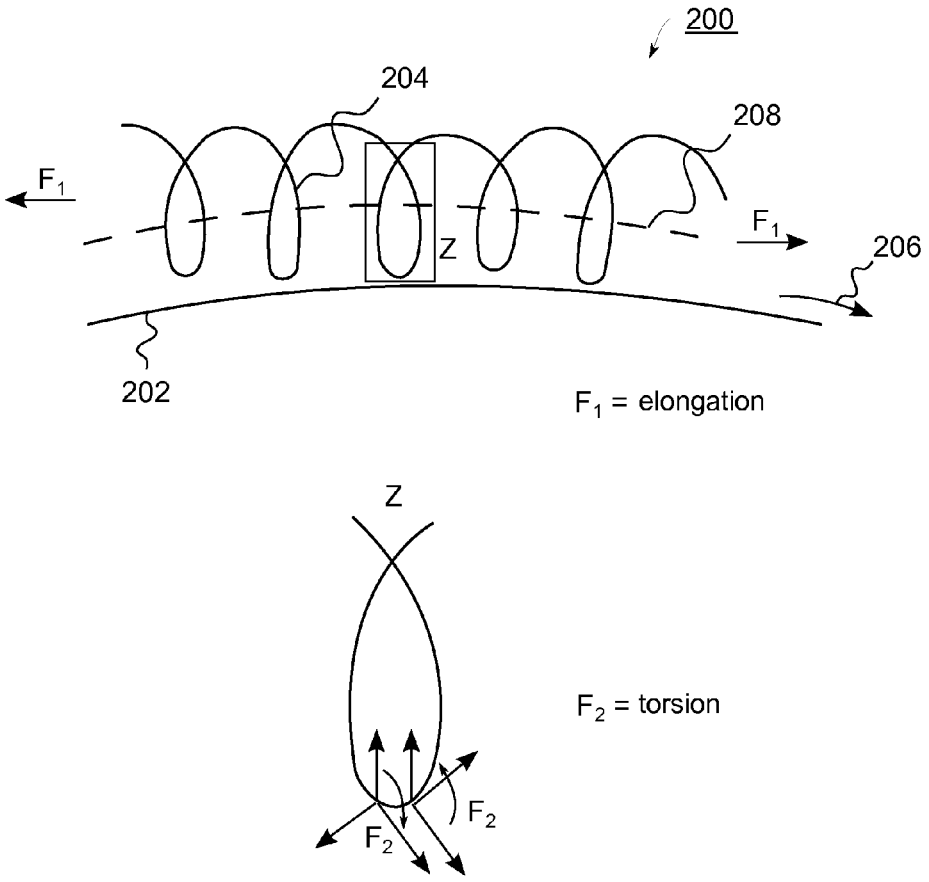
FIG. 2*a* illustrates the winding principle of a deformable electromagnetic coil structure arranged around a curved surface within an item of sports equipment, according to an embodiment.

FIG. 2*a* schematically shows a deformable electromagnetic coil structure 200 which is arranged around a curved surface 202 (e.g., the surface of a ball bladder) within an item of sports equipment (not shown). The electromagnetic coil structure 200 forms a three-dimensional spiral-like curve 204 having non-vanishing geometric torsion and curvature so as to provide an elongation reserve in circumferential direction 206 at least corresponding and/or related to an expected elastic deformation of the item of sports equipment during a game.

Figure 1:
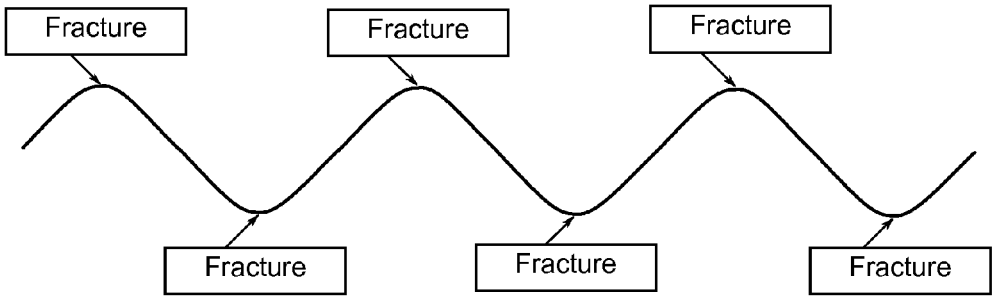
Fig. 1 (Conventional Art)

By the arrangement of FIG. 2*a* in which the electrical conductor of the electromagnetic coil structure 200 is wound essentially spirally around a circular path 208 extending around the curved surface 202 and describing a curved axis of a torus around the curved and/or spherical surface 202, a mechanical load or force due to an elastic deformation of the playing equipment, e.g., a ball, can be distributed more uniformly to all sections of the coil conductor. As can be seen, a traditional two-dimensional meandering structure according to FIG. 1 is extended to a third dimension, thus essentially producing a spiral-like shape of the coil structure 200. If a force $F_1$ now acts in longitudinal direction (and/or circumferential direction) of the spiral, a bending moment which has hitherto only acted on corners of a two-dimensionally meandering conductor may be converted into mechanical torsion $F_2$ which may be distributed uniformly to all points of the coil conductor 204.

FIG. 2*a* illustrates a side view of only one coil 204 wound spirally around an imaginary torus, wherein an internal diameter of the torus essentially corresponds to an outer diameter of the curved and/or spherical surface 202, e.g., the ball bladder. However, the coil structure 200 may also comprise three such deformable electromagnetic spiral coils 204 preferably arranged perpendicular to each other around the curved or spherical surface 202 to form at least three loop antennas in a ball. The resulting loop antennas may then interact with an electromagnetic field-based goal detection system in order to detect, for example, as to whether the ball has crossed a goal line or not.

Figure 2B:
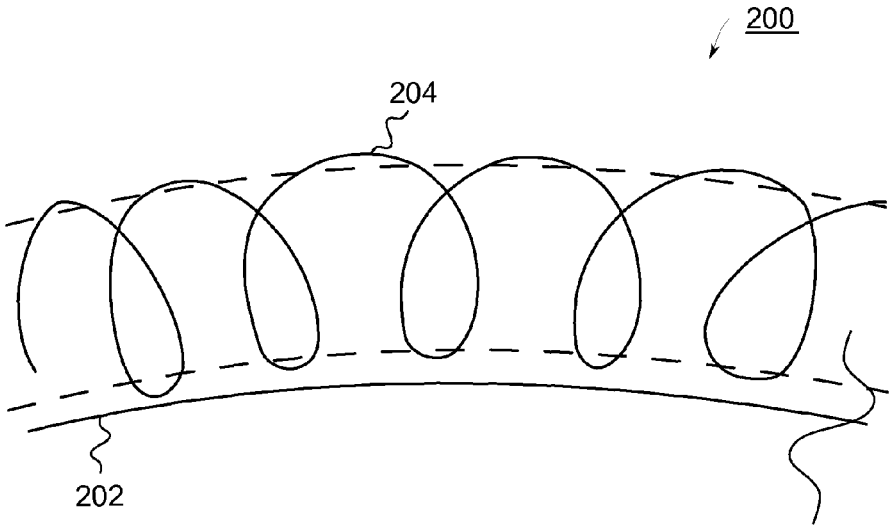
FIG. 2*b* illustrates hollow helices wound around an elastic core.

The at least one spiral or helical coil 204 may, for example, be wound around an elastic core which may comprise, e.g., a caoutchouc-like and/or rubber-like material to provide a certain degree of stability to the coil structure 200. A spiral or helical coil 204 around a torus-like, elastic core 210 is schematically shown in FIG. 2*b*. The supporting, elastic core 210 may then essentially comprise the form of a (full) torus, which—similar to a lifebuoy —is arranged, for example, around the ball bladder with its spherical surface 202. According to other embodiments, the at least one spiral or helical coil 204 may also be wound in the form of a hollow helix, e.g., around the ball bladder or be arranged within the same, i.e., without core 210. The respective design depends mainly on the mechanical properties of the electrical conductor.

Figure 2C:
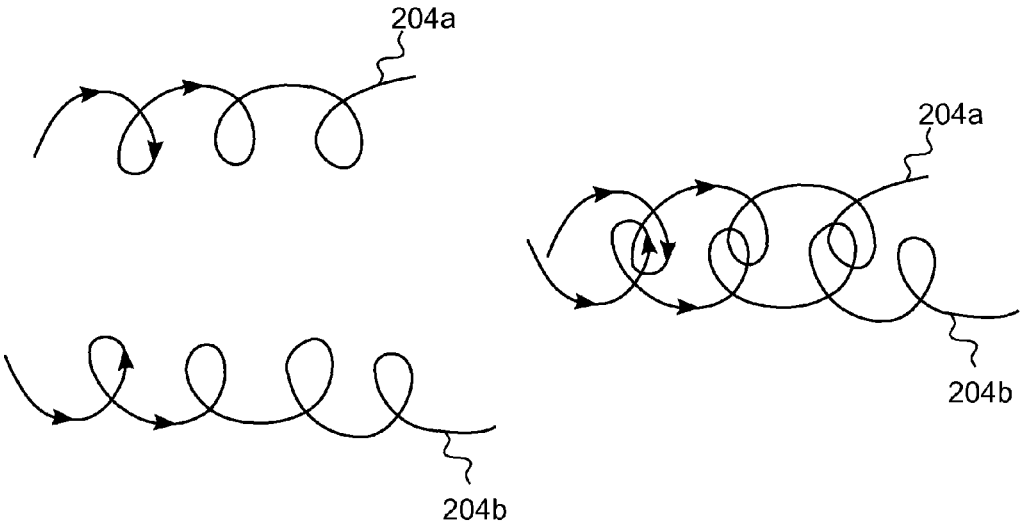
FIG. 2*c* illustrates different spiral orientations.

Furthermore, to improve the stability, one or several (parallel) electrical conductors 204*a* (or sections thereof) of the electromagnetic coil structure 200 may be wound with a first spiral orientation (e.g., right-hand), while other (parallel) electrical conductors 204*b* (or sections thereof) of the electromagnetic coil structure 200 are wound with a second spiral orientation (e.g., right-hand). Different spiral orientations are schematically illustrated in FIG. 2*c*. If wound around the same (imaginary) torus, the first and the second spiral orientations may lead to at least one intersection of the oppositely extending, electrical conductors, thus creating a type of coil plait. In other words, a first and a second sections of at least one conductor may be wound around the lateral surface of a(n) (imaginary) curved cylinder and/or curved tube, i.e., of a torus, in opposite directions, e.g., clockwise and counter-clockwise. Furthermore, the first and the second sections 204*a*, 204*b* of the conductor may be twisted or intertwined.

Figure 3:
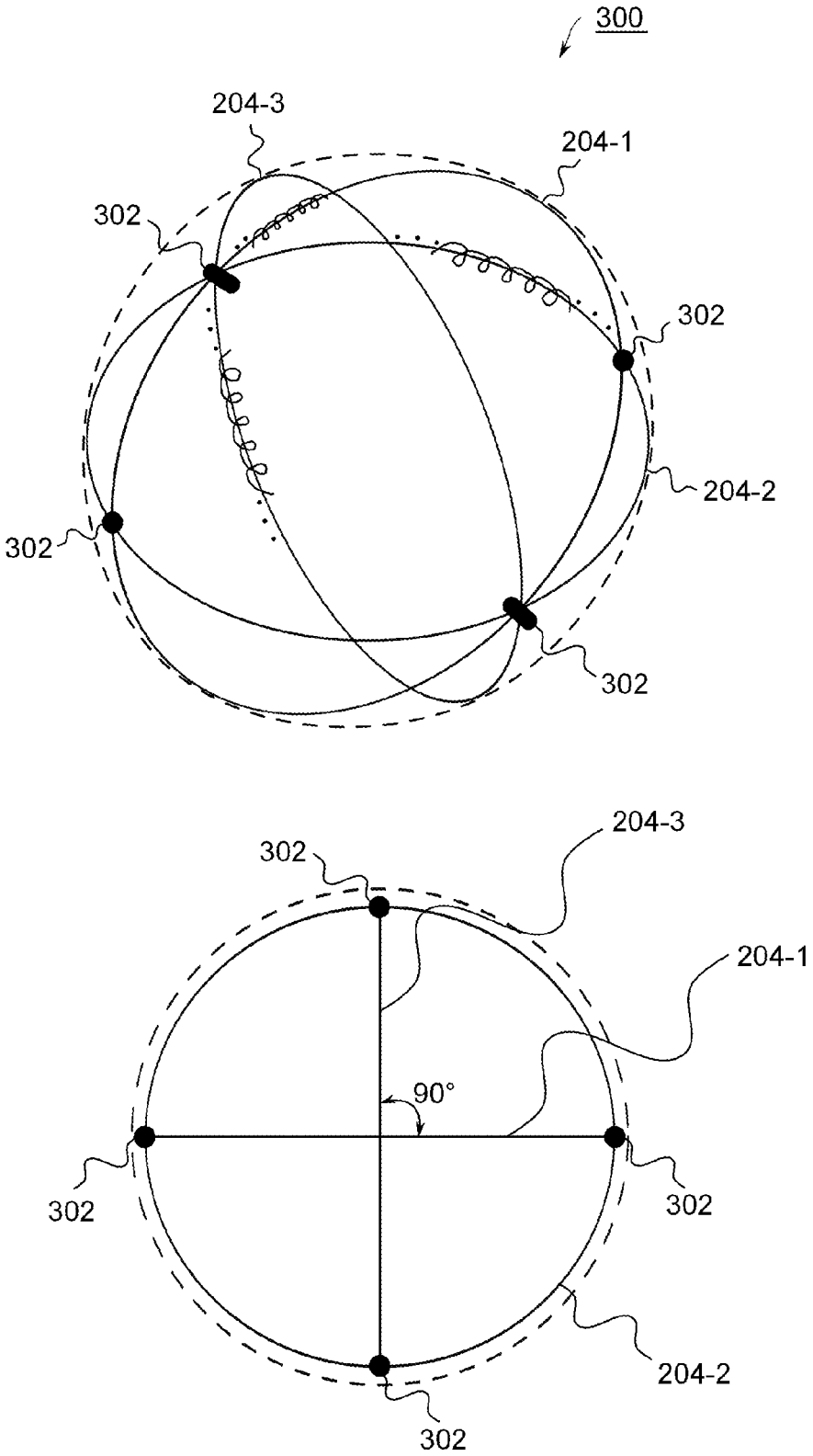
FIG. 3 schematically shows a ball comprising an electromagnetic coil structure comprising three spirally wound electromagnetic coils arranged perpendicular to each other around a curved surface to form at least three loop antennas in the ball.

In a perspective view and a plan view, FIG. 3 schematically shows an embodiment of a ball 300 having a deformable electromagnetic coil structure 200 which comprises a first spiral coil 204-1, a second spiral coil 204-2 and a third spiral coil 204-3. Thus, the three coils 204-1, 204-2, 204-3 extend at least partially coiled (gewendelt), for example, around a ball bladder. Hence, a turn of a coil 204-1, 204-2, 204-3 around the ball bladder extends at least partially spiraled around a curved axis which extends in circumferential direction, i.e., along the circumference of the ball bladder. The three coils are essentially orthogonal to each other. An "orthogonal arrangement" of coils may here be understood as arranging the three coils such that the planes defined by the three different coils are essentially perpendicular to each other. Another definition could be that the surface normals of opening areas of the coils 204-1, 204-2, 204-3 are essentially perpendicular to each other. In order to obtain defined and fixed intersection points between different coils 204, special fixation elements 302 may be provided in front of or at the intersection points, such as lugs, feed-throughs or the like. As can be seen from FIG. 3, the electromagnetic coil structure 200 or its individual coils 204-1, 204-2, 204-3 may be fixed absolutely and relatively by one or more fixation straps 302 at the circumference of, for example, the ball bladder or the outer skin. Thereby, the fixation straps 302 may fix the coils 204-1, 204-2, 204-3 to the inner ball bladder and/or the inner surface of the ball cover material. The fixation straps are here configured to prevent the coils 204-1, 204-2, 204-3 from displacing in transversal direction relative to the curved surface of the bladder or the cover material. The fixation straps may also be configured in a way to allow a free movement of the coils 204-1, 204-2, 204-3 in their respective circumferential or longitudinal direction along the curved surface of the bladder or the cover material. Furthermore, the mutual orthogonality of the coils 204-1, 204-2, 204-3 may essentially be kept due to the use of the fixation straps.

The description and drawings merely illustrate the principles of some embodiments. It will thus be appreciated that those skilled in the art will be able to devise various arrangements that, although not explicitly described or shown herein, embody the principles of the invention. Although embodiments have been illustrated with respect to goal-detection systems, alternative embodiments may also relate to anti-theft devices (e.g., the insertion of flexible coils into or onto goods), further sports, e.g., ice hockey. Embodiments may also be useful for surveying security zones, for example by integrating flexible and flat coils in shoes or the like.

Furthermore, all examples recited herein are principally intended expressly to be for pedagogical purposes only to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Furthermore, the following claims are hereby incorporated into the Detailed Description, where each claim may stand on its own as a separate embodiment. While each claim may stand on its own as a separate embodiment, it is to be noted that—although a dependent claim may refer in the claims to a specific combination with one or more other claims—other embodiments may also include a combination of the dependent claim with the subject matter of each other dependent claim. Such combinations are proposed herein unless it is stated that a specific combination is not intended. Furthermore, it is intended to include also features of a claim to any other independent claim even if this claim is not directly made dependent to the independent claim.

It is further to be noted that methods disclosed in the specification or in the claims may be implemented by a device having means for performing each of the respective steps of these methods.

Further, it is to be understood that the disclosure of multiple steps or functions disclosed in the specification or claims may not be construed as to be within the specific order. Therefore, the disclosure of multiple steps or functions will not limit these to a particular order unless such steps or functions are not interchangeable for technical reasons. Furthermore, in some embodiments a single step may include or may be broken into multiple sub steps. Such sub steps may be included and part of the disclosure of this single step unless explicitly excluded.

The invention claimed is:

1. An elastically deformable item of sports equipment, comprising:

at least one deformable electromagnetic coil structure arranged around a curved surface within the item of sports equipment, wherein the at least one deformable electromagnetic coil structure is wound spirally around a curved axis, the curved axis being curved according to the curved surface to provide an elongation reserve related to a maximum elastic deformation of the item of sports equipment; wherein the curved axis extends completely around the circumference of the item of sports equipment, and the at least one deformable electromagnetic coil structure is wound spirally around an entire length of the curved axis, thereby extending completely around the circumference of the item of sports equipment.

2. The item of sports equipment according to claim 1, wherein the curved surface is a spherical surface in an undeformed condition of the item of sports equipment; and a length of at least one turn of the at least one deformable electromagnetic coil structure around the spherical surface is larger than the circumference of the spherical surface.

3. The item of sports equipment according to claim 1, wherein at least one electrical conductor of the at least one deformable electromagnetic coil structure is arranged essentially spirally along a circular path on the curved surface.

4. The item of sports equipment according to claim 3, wherein at least one electrical conductor of the at least one deformable electromagnetic coil structure includes a first section being wound with a first spiral orientation and a second section being wound with a second spiral orientation; and the first spiral orientation and the second spiral orientation lead to at least one intersection of the first section and the second section of the at least one electrical conductor.

5. An elastically deformable item of sports equipment, comprising:

at least one deformable electromagnetic coil structure arranged around a curved surface within the item of sports equipment, wherein the at least one deformable electromagnetic coil structure is wound spirally around a curved axis, the curved axis being curved according to the curved surface to provide an elongation reserve related to a maximum elastic deformation of the item of sports equipment; wherein at least one electrical conductor of the at least one deformable electromagnetic coil structure includes a first section wound with a first spiral orientation and a second section wound with a second spiral orientation, the first spiral orientation and the second spiral orientation lead to at least one intersection of the first section and the second section of the at least one electrical conductor, and the first section and the second section of the at least one electrical conductor form a twisted or braided pair of conductors.

6. An elastically deformable item of sports equipment, comprising:

at least one deformable electromagnetic coil structure arranged around a curved surface within the item of sports equipment, wherein the at least one deformable electromagnetic coil structure is wound spirally around a curved axis, the curved axis being curved according to the curved surface to provide an elongation reserve related to a maximum elastic deformation of the item of sports equipment; wherein at least one electrical conductor of the at least one deformable electromagnetic coil structure is wound around at least one of an elastic and a flexible carrier material, the flexible carrier material being arranged along a circumferential direction of the curved surface.

7. The item of sports equipment according to claim 1, further comprising:

a fixing element configured to fix a position of the at least one deformable electromagnetic coil structure on the curved surface underneath an outer skin of the item of sports equipment.

8. The item of sports equipment according to claim 7, wherein the fixing element comprises:

seams of the outer skin or fixation straps arranged around the curved surface.

9. The item of sports equipment according to claim 1, further comprising:

at least one capacitive element coupled to the at least one deformable electromagnetic coil structure to form a resonant circuit for a frequency in a range of 10 kHz to 150 kHz.

10. The item of sports equipment according to claim 9, wherein the at least one capacitive element is integrated into a cover material of the item of sports equipment or into a patch thereof.

11. The item of sports equipment according to claim 1, further comprising:

at least three spirally wound coils arranged perpendicular to each other around the curved surface to form at least three loop antennas in the item of sports equipment.

12. The item of sports equipment according to claim 11, wherein each of the at least three spirally wound coils is tuned separately to a respective resonant frequency by at least one capacitor.

13. The item of sports equipment according to claim 1, wherein the item of sports equipment is a ball having a ball bladder and an outer ball skin; and the at least one deformable electromagnetic coil structure is arranged between the ball bladder and the outer ball skin.

14. A method for manufacturing an elastically deformable item of sports equipment, the method comprising:

arranging at least one deformable electromagnetic coil structure around a curved surface within the item of sports equipment, such that the at least one deformable electromagnetic coil structure is wound spirally around a curved axis, the curved axis being curved according to the curved surface to provide an elongation reserve related to a maximum elastic deformation of the item of sports equipment, wherein the curved axis extends completely around the circumference of the item of sports equipment, and the at least one deformable electromagnetic coil structure is wound spirally around an entire length of the curved axis, thereby extending completely around the circumference of the item of sports equipment.

15. The method for manufacturing the item of sports equipment according to claim 14, wherein the item of sports equipment is a ball.

16. The method for manufacturing the item of sports equipment according to claim 14, wherein the at least one deformable electromagnetic coil structure forms a three-dimensional curve having non-vanishing geometric torsion and curvature to provide the elongation reserve related to the maximum elastic deformation of the item of sports equipment.

17. The item of sports equipment according to claim 1, wherein the item of sports equipment is a ball.

18. The item of sports equipment according to claim 1, wherein the at least one deformable electromagnetic coil structure forms a three-dimensional curve having non-vanishing geometric torsion and curvature to provide the elongation reserve related to the maximum elastic deformation of the item of sports equipment.

19. The item of sports equipment according to claim 1, wherein the at least one deformable electromagnetic coil structure includes at least one helical coil wound around the curved axis; and the curved axis extends along the curved surface within the item of sports equipment.

20. The method for manufacturing the item of sports equipment according to claim 14, wherein the at least one deformable electromagnetic coil structure includes at least one helical coil wound around the curved axis; and the curved axis extends along the curved surface within the item of sports equipment.

* * * * *